US011350741B2

(12) United States Patent
Chang Chien

(10) Patent No.: US 11,350,741 B2
(45) Date of Patent: Jun. 7, 2022

(54) COLLAPSIBLE ORGANIZER AND METHOD FOR UTILIZING THEREOF

(71) Applicant: EP Family Corp., Walnut, CA (US)

(72) Inventor: Peiling Chang Chien, Walnut, CA (US)

( * ) Notice: Subject to any disclaimer, the term of this patent is extended or adjusted under 35 U.S.C. 154(b) by 19 days.

(21) Appl. No.: 17/025,327

(22) Filed: Sep. 18, 2020

(65) Prior Publication Data

US 2022/0087416 A1 Mar. 24, 2022

(51) Int. Cl.
*A47B 47/02* (2006.01)
*A47B 55/02* (2006.01)

(52) U.S. Cl.
CPC ..... *A47B 47/027* (2013.01); *A47B 55/02* (2013.01)

(58) Field of Classification Search
CPC ... B65D 9/18; B65D 7/32; B65D 9/14; B65D 9/22; B65D 9/12; B65D 9/10; B65D 9/20; B65D 9/16; B65D 11/18; B65D 7/14; B65D 7/20; B65D 7/28; B65D 7/26; B65D 11/1873; B65D 21/086; B65D 7/24; B65D 1/225; B65D 5/3628; B65D 7/30; A47F 5/13; A47F 5/14; A47F 5/10; A47F 3/004; A47B 55/02; A47B 63/00; A47B 47/027; A47B 47/00; A47B 47/0008; A47B 47/0041; A47B 57/0058; A47B 47/0091; A47B 47/028
USPC ..... 211/195, 85, 132.1, 10, 11; 220/6, 7
See application file for complete search history.

(56) References Cited

U.S. PATENT DOCUMENTS 797,871 A * 8/1905 Smith ..... B65D 11/1833 220/7
1,125,100 A * 1/1915 Hoover ..... B65D 7/20 220/495
1,416,150 A * 5/1922 Winter ..... A01K 31/002 220/6
1,443,901 A * 1/1923 Murray ..... B65D 7/26 220/6
1,521,936 A * 1/1925 Fadden ..... B65D 7/26 220/6
1,890,743 A * 12/1932 Murphy ..... A47F 5/13 108/69
1,905,137 A * 4/1933 Blomberg ..... B65D 85/50 220/6

(Continued)

OTHER PUBLICATIONS

Definition of Mold, DIctionary.com, https://www.dictionary.com/browse/mold (Year: 2021).*

*Primary Examiner* — Devin K Barnett
(74) *Attorney, Agent, or Firm* — Tommy S F Wang; Wang IP Law Group, P.C.

(57) ABSTRACT

The present application discloses a collapsible organizer of the present application comprises a base, a pair of side walls and a pair of top rods. The pair of side walls is rotatably coupled to the base, wherein each of the side walls comprises a pair of slots. Each of the top rods comprises a straight portion and a pair of insertions coupled to two ends of the straight portion correspondingly, one of the insertions is insertably coupled to one of the slots of one of the side walls, another one of the insertions is insertably coupled to one of the slots of another one of the side walls. A method for utilizing the aforementioned collapsible organizer is also disclosed, comprising: rotating the pair of the side walls; and inserting the pair of top rods to the slots of the pair of side walls.

9 Claims, 4 Drawing Sheets

(56) References Cited

U.S. PATENT DOCUMENTS

| | | | | | |
|---|---|---|---|---|---|
| 2,466,220 | A * | 4/1949 | Ferguson | B65D 7/26 | 220/6 |
| 2,803,369 | A * | 8/1957 | Fleetwood | B65D 21/062 | 220/485 |
| 3,378,161 | A * | 4/1968 | Lookabaugh | B65D 7/26 | 220/6 |
| 4,901,867 | A * | 2/1990 | Petty, Jr. | A47B 31/04 | 211/46 |
| 5,931,326 | A * | 8/1999 | Weng | B65D 7/24 | 220/4.33 |
| 6,508,376 | B1 * | 1/2003 | Chiang | B42F 15/0094 | 211/46 |
| 6,691,382 | B1 * | 2/2004 | Su | B65D 7/20 | 24/335 |
| 6,726,045 | B1 * | 4/2004 | Chen | A47B 47/0075 | 220/4.33 |
| 9,648,953 | B1 * | 5/2017 | Kuo | A47F 5/01 | |
| 2005/0040166 | A1 * | 2/2005 | Nolet | B65D 11/1833 | 220/6 |
| 2007/0210083 | A1 * | 9/2007 | Li | B65D 11/1833 | 220/6 |
| 2009/0014444 | A1 * | 1/2009 | Chung | B65D 7/20 | 220/6 |
| 2012/0111819 | A1 * | 5/2012 | Chung | A47B 87/00 | 211/195 |
| 2016/0052665 | A1 * | 2/2016 | Tsai | B65D 7/12 | 220/494 |

* cited by examiner

COLLAPSIBLE ORGANIZER AND METHOD FOR UTILIZING THEREOF

TECHNICAL FIELD OF THE INVENTION

The present application generally relates to organizers, and more particularly, to a collapsible organizer and method for utilizing the collapsible organizer.

BACKGROUND OF THE INVENTION

There are many different organizers in the market such as drawer style or partition style etc. However, the size of the above-mentioned organizer is fixed, making the logistics and transportation to be inconvenient. In addition, it is hard to store the organizer for those people who has fixed storage space.

Therefore, a need remains for a collapsible organizer and method for utilizing the collapsible organizer to provide the logistics companies and the users an organizer with more convenient shipping, and storage size.

SUMMARY OF THE INVENTION

The present application discloses a collapsible organizer and method for utilizing the collapsible omanizer to provide the logistics companies and the users an organizer with more convenient shipping and storage size.

The collapsible organizer of the present application comprises a base, a pair of side walls and a pair of top rods. The pair of side walls is rotatably coupled to the base, wherein each of the side walls comprises a pair of vertically extending sleeve portions each having a vertical slot therein. Each of the top rods comprises a horizontal straight portion and a pair of vertical insertions coupled to two ends of the horizontal straight portion correspondingly, one of the vertical insertions is insertably coupled to one of the vertical slots of one of the side walls, another one of the vertical insertions is insertably coupled to one of the vertical slots of another one of the side walls.

In various exemplary embodiments, wherein each of the side walls further comprises a frame body having an outer surface and an opposite inner surface, the pair of sleeve portions protrude inwardly from the inner surface of each frame body respectively. Each of the side walls further comprises at least one hook, the base comprises a base frame and a pair of horizontal rods coupled to the base frame, the at least one hook of each of the side walls is rotatably hooked to one of the horizontal rods. The at least one hook and the frame body of each of the side walls are molded integrally.

In various exemplary embodiments, wherein each of the side walls further comprises a frame body having an outer surface and an opposite inner surface, the pair of sleeve portions protrude inwardly from the inner surface of each frame body respectively. Each of the side walls further comprises at least one hook, the base comprises a base frame and a pair of horizontal rods coupled to the base frame, the at least one hook of each of the side walls is rotatably hooked to one of the horizontal rods. Specifically, each of the side walls comprises two hooks.

In various exemplary embodiments, wherein each of the side walls further comprises a frame body having an outer surface and an opposite inner surface, the pair of sleeve portions protrude inwardly from the inner surface of each frame body respectively. Each of the side walls further comprises at least one hook, the base comprises a base frame and a pair of horizontal rods coupled to the base frame, the at least one hook of each of the side walls is rotatably hooked to one of the horizontal rods. The base further comprises at least one support rod coupled to the base frame, wherein the pair of horizontal rods is supported by the at least one support rod. Specifically, the base comprises two support rods.

In various exemplary embodiments, wherein each of the top rods further comprises a pair of protrusions coupled between the horizontal straight portion and each of the vertical insertions.

In various exemplary embodiments, wherein the base comprises a plurality of pads.

In various exemplary embodiments, wherein each of the side walls further comprises a board and a wall frame, the board and the pair of sleeve portions are coupled to the wall frame. The board comprises a board body and a recessed portion. A handle portion is formed between the recessed portion and the frame body.

The method for utilizing the aforementioned collapsible organizer is also disclosed. The method comprises: rotating the pair of the side walls; inserting the pair of vertical insertions of one of the top rods into one of the vertical slots of one of the side walls and one of the vertical slots of another one of the side walls; and inserting the pair of insert ions of another one of the top rods into another one of the vertical slots of one of the side walls and another one of the vertical slots of another one of the side walls.

In various exemplary embodiments, wherein after inserting the pair of insert ions of another one of the top rods into another one of the vertical slots of one of the side walls and another one of the vertical slots of another one of the side walls, the method further comprises: removing the pair of the top rods from the pair of the side walls; and collapsing the pair of the side walls toward the base.

Based on the above, the collapsible organizer of the present application may be stored in a comparably flat shape since the pair of side walls is rotatably coupled to the base and the pair of top rods are removable. As such, the logistics companies may transport the collapsible organizer with greater amount compared to the traditional organizers. The user may also store the collapsible organizer with much smaller size.

In addition, the recessed portion of the board body may also form the handle portion for the user. Therefore, the user may hold up and down the collapsible organizer more conveniently. The utilization of the hooks may also decrease the cost since there is no need to install complex structure for rotation.

Numerous other advantages and features of the present application will become readily apparent from the following detailed description of disclosed embodiments, from the claims and from the accompanying drawings.

BRIEF DESCRIPTION OF THE DRAWINGS

The objects, features and advantages of the present application will be more readily appreciated upon reference to the following disclosure when considered in conjunction with the accompanying drawings, wherein like reference numerals are used to identify identical components in the various views, and wherein reference numerals with alphabetic characters are utilized to identify additional types, instantiations or variations of a selected component embodiment in the various views, in which.

DETAILED DESCRIPTION OF DISCLOSED EMBODIMENTS

Figure 1:
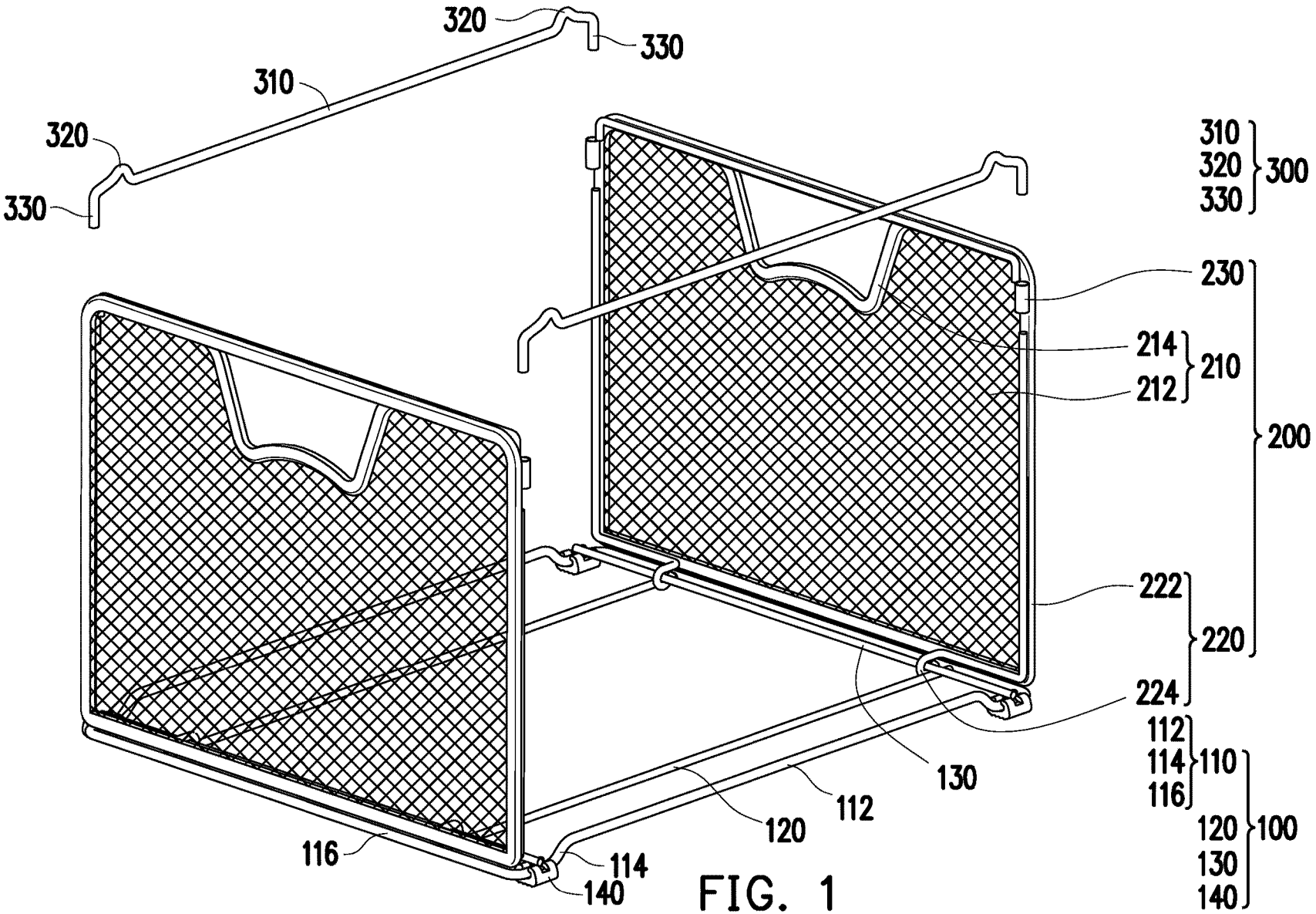
FIG. 1 shows an exploded view of a collapsible organizer of the present application.

Reference wall now be made in detail to the present representative embodiments of the present application, examples of which are illustrated in the accompanying drawings. Wherever possible, the same reference numbers are used in the drawings and the description to refer to the same or like parts.

FIG. 1 shows an exploded view of a collapsible organizer 10 of the present application.

Referring to FIG. 1, the collapsible organizer 10 of the present application comprises a base 100, a pair of side walls 200 and a pair of top rods 300.

The base 100 comprises a base frame 110, at least one support rods 120, a pair of horizontal rods 130 and a plurality of pads 140.

The base frame 110 comprises two elevated portions 112, four slopes 114 and two lower portions 116. The two elevated portions 112 are located oppositely to each other. The two lower portions 116 are located oppositely to each other. The slopes 114 are located at each corners and between the elevated portions 112 and the lower portions 116.

The base 100 comprises two support rods 120 as an example but is not limited. The support rods 120 are coupled to the base frame 110. More specifically, the support rods 120 are coupled to the lower portions 116.

The horizontal rods 130 are supported by the support rods 120 and are located at opposite sides of the base frame 110. Specifically, the horizontal rods 130 are parallel to and near to the lower portions 116.

The pads 140 are coupled to the base frame 110, Specifically, the base 100 comprises four pads 140 at each comers. Each, of the pads 140 are coupled to the lower portions 116 and next to each of the slopes 114.

Each of the side wall 200 comprises a board 210, a wall frame 220 and a pair of vertically extending sleeve portions 230. The board comprises a board body 212 and a recessed portion 214. The wall frame 220 comprises a frame body 222 and at least one hook 224. A handle portion is formed between the recessed portion 214 and the frame body 222 for allowing the user to hold up and down the collapsible organizer 10 more conveniently. The size and the shape of the recessed portion 214 are not limited as long as the user could hold the collapsible organizer 10.

Each of the wall frame 220 comprises two hooks 224 as an example but is not limited. The hooks 224 are coupled to the frame body 222. More specifically, the hooks 224 and the frame body 222 are molded integrally.

The hooks 224 of each of the wall frame 220 are rotatably hooked to one horizontal rods 130. In addition, the hooks 224 are located between two support rods 120. As such, the side wall 200 may be fixed at a specific location and may not be moved horizontally. In the present application, the board 210 and the wall frame 220 have substantially similar shape but is not limited.

Each of the top rods 300 comprises a horizontal straight portion 310, a pair of protrusions 320 and a pair of vertical insertions 330. The pair of vertical insertions 330 is coupled to two ends of the horizontal straight portion 310. The protrusions 320 are coupled between the horizontal straight portion 310 and the vertical insertions 330. The protrusions 320 allows the user to have specific points for lifting the top rods 320.

Figure 2:
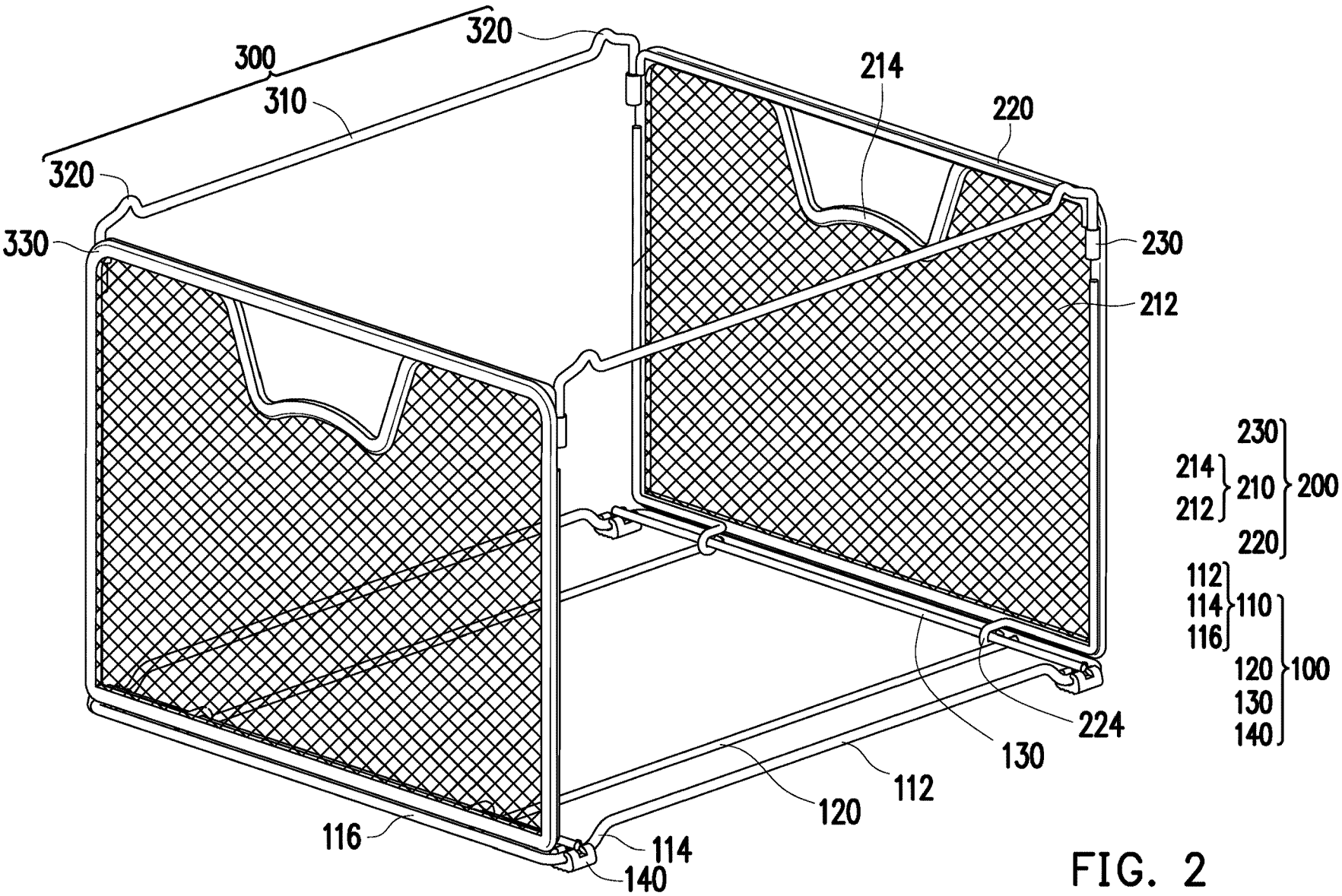
FIG. 2 shows the collapsible organizer of the present application in an assembled mode.

FIG. 2 shows the collapsible organizer 10 of the present application in an assembled mode.

As shown in FIG. 2, one of the vertical insertions 330 is insertably coupled to one of the slots of the vertically extending sleeve portions 230 of one of the side walls 200. Another one of the vertical insertions 330 is insertably coupled to one of the slots of the vertically extending sleeve portions 230 of another one of the side walls 200. Simply put the vertical insertions 330 are insertably coupled to the slots of the sleeve portions 230 of different side walls 200. As such, the top rods 300 may fix the side walls 220 at specific locations.

The space formed between the top rods 300, the base 100 and the side wall 200 may allow the user to put the documents such as files, paper or notebook etc.

Figure 3A:
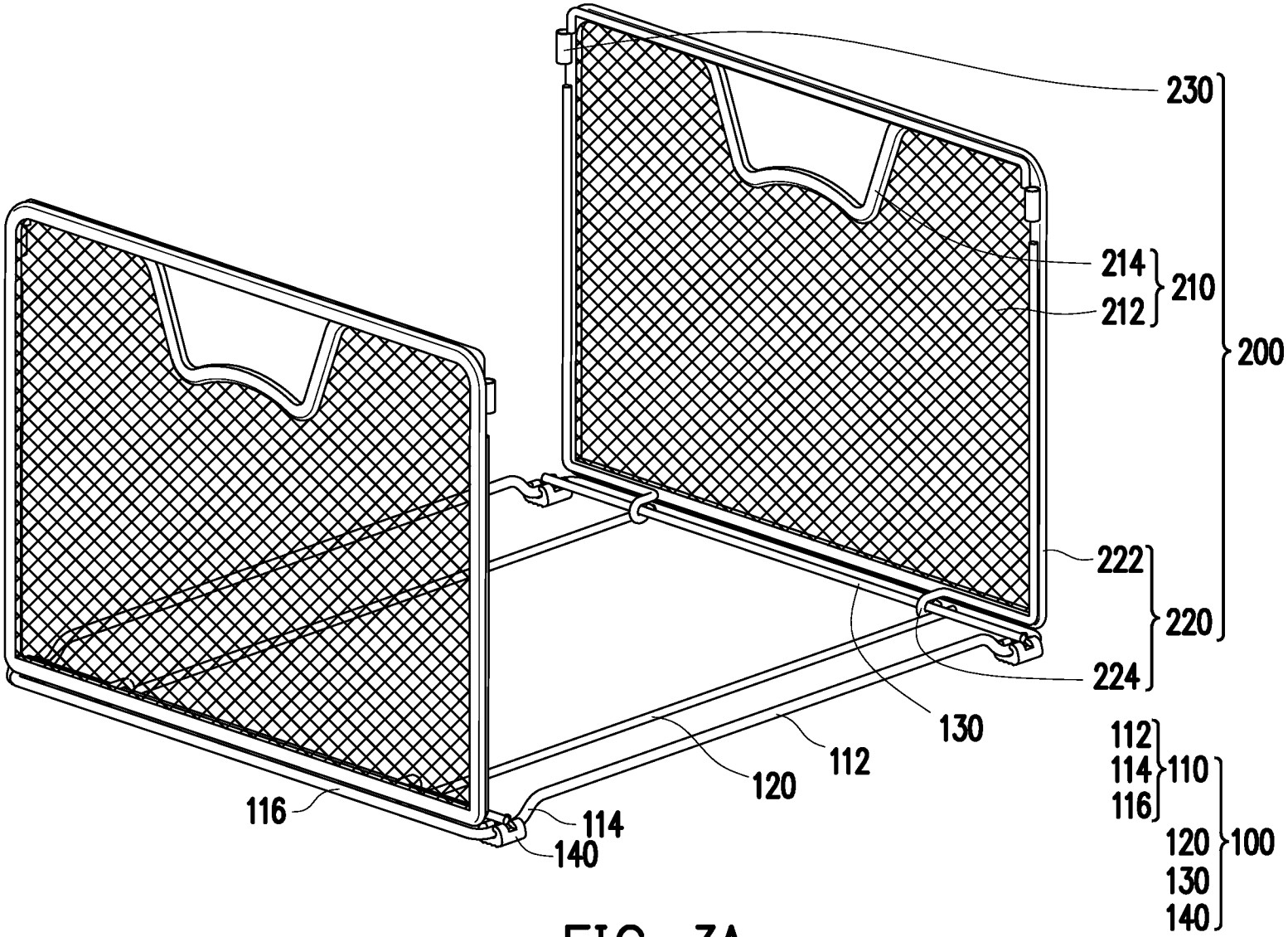
FIGS. 3A-3B show the collapsible organizer of the present application in a collapsed mode.
Figure 3B:
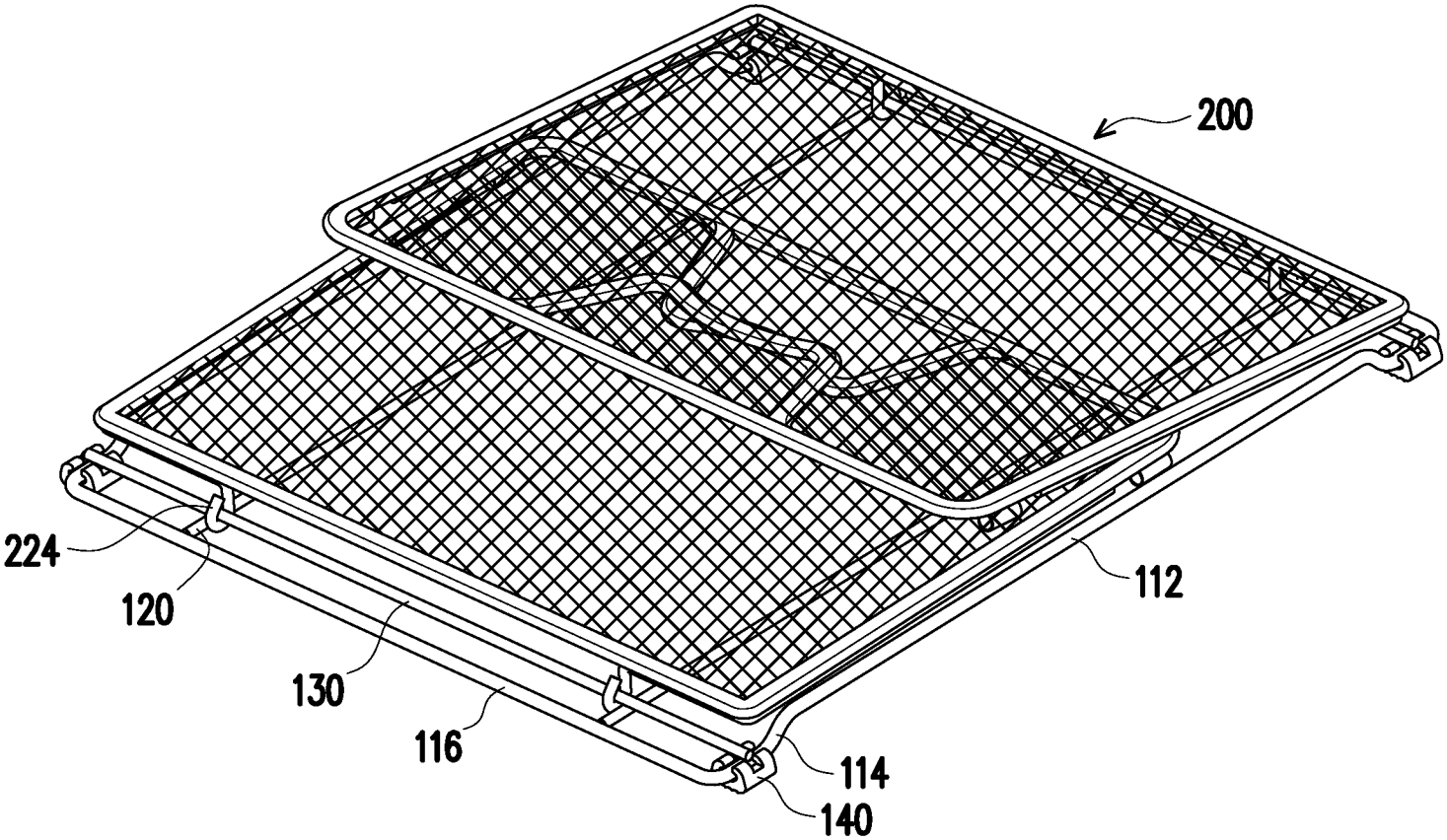

FIGS. 3A-3B show the collapsible organizer 10 of the present application in a collapsed mode.

If the user or logistic company would like to store the collapsible organizer 10 of the present application, they may remove the pair of the top rods 330 from the pair of the side walls. 200 as shown in FIG. 3A.

After that, collapsing the pair of the side walls 200 toward the base 100. As shown in FIG. 3B, the side walls 200 may be rotated about the horizontal rods 130 since the hooks 224 are hooked to the horizontal rods 130. As such, the size may be much smaller than traditional organizer.

If the user would like to use the collapsible organizer 10 of the present application, the steps shown in FIGS. 3A-3B may be reversed. In detail, the user may rotate the pair of the side walls 200 from the mode as shown in FIG. 3B to the mode as shown in FIG. 3A.

After that, inserting the pair of vertical insertions 330 of one of the top rods 300 into the slots of the sleeve portions 230 of different side walls 200. Then, inserting the pair of vertical insertions 330 of another one of the top rods 300 into another slots of the sleeve portions 230 of different side walls 200.

Based on the above, the collapsible organizer of the present application may be stored in a comparably flat shape since the pair of side walls is rotatably coupled to the base and the pair of top rods are removable. As such, the logistics companies may transport the collapsible organizer with greater amount compared to the traditional organizers. The user may also store the collapsible organizer with much smaller size.

In addition, the recessed portion of the board body may also form the handle portion for the user. Therefore, the user may hold up and down the collapsible organizer more conveniently. The utilization of the hooks The present application utilizes the first bottom, the second bottom, the third bottom and the fourth bottom to support the bottom base during the larger hamper mode. As such, the bottom base may be supported not only during the smaller hamper mode, which the bottom base is supported by the first extension wall, the second extension wall, the third extension wall and the fourth extension wall, but during the larger hamper mode.

It will be apparent to those skilled in the art that various modifications and variations can be made to the structure of the present application without departing from the scope or spirit of the present application. In view of the foregoing, it is intended that the present application cover modifications and variations of this application provided they fall within the scope of the following claims and their equivalents.

What is claimed is:

1. A collapsible organizer, comprising:

a base comprising a base frame, two support rods and a pair of horizontal rods, wherein the pair of horizontal rods are perpendicular relative to the support rods and are coupled to the base frame and supported by the two support rods;

a pair of side walls rotatably coupled to the base, wherein each of the side walls comprises:

at least one hook, a generally rectangular frame body having an outer surface and an opposite inner surface, and a pair of vertically extending sleeve portions that protrude inwardly from the inner surface of each frame body respectively, wherein each sleeve portion defines a vertical slot therein;

wherein each hook is rotatably hooked to one of the horizontal rods and located between the two support rods; and a pair of top rods, each of the top rods consisting of:

a horizontal straight portion, a pair of vertical insertions coupled to the horizontal straight portion, and a pair of protrusions between the horizontal straight portion and the vertical insertions, wherein each vertical insertion comprises a bottom free end;

wherein for each top rod:

one of the vertical insertions is configured to be inserted downwardly into a top portion of one of the vertical slots of one of the side walls, and another one of the vertical insertions is configured to be inserted downwardly into a top portion of one of the vertical slots of another one of the side walls so that each top rod extends between and connects the pair of side walls when the collapsible organizer is in an assembled mode;

wherein the vertical insertions of the pair of top rods are configured to be removed from the vertical slots of the pair of side walls so that the pair of top rods can be removed from the pair of side walls to collapse the side walls toward the base.

2. The collapsible organizer as claimed in claim 1, wherein the at least one hook and the frame body of each of the side walls are molded integrally.

3. The collapsible organizer as claimed in claim 1, wherein the at least one hook of each of the side walls comprises two hooks.

4. The collapsible organizer as claimed in claim 1, wherein the base comprises a plurality of pads.

5. The collapsible organizer as claimed in claim 1, wherein each of the side walls further comprises a board, wherein for each side wall: the board is coupled to the frame body.

6. The collapsible organizer as claimed in claim 5, wherein each board comprises a board body and a recessed portion.

7. The collapsible organizer as claimed in claim 6, wherein for each side wall: a handle portion is formed between the recessed portion and the frame body.

8. A method for utilizing a collapsible organizer, comprising the steps of:

providing a base; the base comprising a base frame, two support rods and a pair of horizontal rods; wherein the pair of horizontal rods are perpendicular relative to the support rods and are coupled to the base frame and supported by the two support rods;

providing a pair of side walls, the pair of side walls are rotatably coupled to the base; each of the side walls comprises:

at least one hook, a generally rectangular frame body having an outer surface and an opposite inner surface, and a pair of vertically extending sleeve portions that protrude inwardly from the inner surface of each frame body respectively; wherein each sleeve portion defines a vertical slot therein;

wherein each hook is rotatably hooked to one of the horizontal rods and located between the two support rods;

providing a pair of top rods; each of the top rods consisting of:

a horizontal straight portion, a pair of vertical insertions coupled to the horizontal straight portion, and a pair of protrusions between the horizontal straight portion and the vertical insertions, wherein each vertical insertion comprises a bottom free end;

wherein for each top rod:

one of the vertical insertions is configured to be inserted downwardly into a top portion of one of the vertical slots of one of the side walls, and another one of the vertical insertions is configured to be inserted downwardly into a top portion of one of the vertical slots of another one of the side walls so that each top rod extends between and connects the pair of side walls when the collapsible organizer is in an assembled mode;

wherein the vertical insertions of the pair of top rods are configured to be removed from the vertical slots of the pair of side walls so that the pair of top rods can be removed from the pair of side walls to collapse the side walls toward the base;

rotating the pair of side walls to an upright position;

inserting the pair of vertical insertions of a first corresponding top rod from the pair of top rods downwardly into one of the vertical slots of a first corresponding side wall from the pair of side walls and one of the vertical slots of a second corresponding side wall from the pair of side walls; and inserting the pair of vertical insertions of a second corresponding top rod from the pair of top rods downwardly into another one of the vertical slots of the first corresponding side wall and another one of the vertical slots of the second corresponding side wall, so that the pair of top rods extend between and connect the pair of side walls placing the collapsible organizer is in the assembled mode.

9. The method for utilizing the collapsible organizer as claimed in claim 8, further comprising the steps of:

removing the pair of the top rods from the pair of the side walls; and collapsing the pair of the side walls toward the base.

* * * * *